United States Patent [19]

Haga et al.

[11] Patent Number: 4,890,770

[45] Date of Patent: Jan. 2, 1990

[54] DISPENSING AND CLOSING PACKAGE FOR LIQUID PRODUCTS

[75] Inventors: Tomoyuki Haga; Naotake Ozaki, both of Yokohama; Kazushi Koinuma, Tokyo; Masatoshi Fujima, Tokyo; Seishi Suzuki, Tokyo, all of Japan

[73] Assignees: Shiseido Company Limited; Toppan Printing Company Limited, both of Tokyo, Japan

[21] Appl. No.: 203,923

[22] Filed: Jun. 8, 1988

[30] Foreign Application Priority Data

Jun. 17, 1987 [JP] Japan ..... 62-93141[U]

[51] Int. Cl.[4] ..... B67D 1/16

[52] U.S. Cl. ..... 222/109; 222/571

[58] Field of Search ..... 215/218, 221, 330, 354; 222/108–109, 111, 481, 488–489, 544–545, 548–549, 551, 553, 562, 567–568, 570–571

[56] References Cited

U.S. PATENT DOCUMENTS

| | | | |
|---|---|---|---|
| 2,601,039 | 6/1952 | Livingstone | 222/109 |
| 2,601,040 | 6/1952 | Livingstone | 222/109 |
| 3,434,637 | 3/1969 | Marcel | 222/570 |
| 3,833,150 | 9/1974 | Visser-Patings | 222/571 X |
| 4,128,189 | 12/1978 | Baxter | 222/109 |
| 4,298,145 | 11/1981 | Iida | 222/478 |
| 4,550,862 | 11/1985 | Barker et al. | 222/109 |
| 4,664,295 | 5/1987 | Iida | 222/109 |
| 4,671,421 | 6/1987 | Reiber et al. | 215/228 |
| 4,706,829 | 11/1987 | Li | 215/354 |

FOREIGN PATENT DOCUMENTS 61-180961 11/1986 Japan .

*Primary Examiner*—Michael S. Huppert
*Attorney, Agent, or Firm*—Staas & Halsey

[57] ABSTRACT

A dispensing and closing package for liquid products has a cap which also serves as a measuring cup. The cap fits on the outer circumference of a dispensing cylinder. A passageway is provided adjacent to a common point between the cap and the dispensing cylinder running between the container body and the inside of the cap. Residual liquid products adherent in the inside of the cap returns into the container body through the passageway.

7 Claims, 13 Drawing Sheets

DISPENSING AND CLOSING PACKAGE FOR LIQUID PRODUCTS

BACKGROUND OF THE INVENTION

1. Field of the Invention:

This invention relates to a dispensing and closing package for liquid products like detergent or edible oil, and it particularly relates to the aforesaid package, adapted to return residual liquid from around the dispensing spout or the cap into the container body. The invention also prevents general mess inherent when pouring liquid products.

2. Description of the Related Art:

In the past, viscous liquid products like detergent or edible oil were easy to drip out onto containers, resulting in a mess over the surface of the relative container. In the prior art, for example, Japanese Patent Publication No. 59-152160 discloses a package method which forms a dispensing adapter on the mouth of the container, having a smaller dispensing cylinder than the diameter of the mouth, whereas the return hole is located on the basic part of the cylinder from which the dripped liquid shall return into the container body.

Generally, by the above disclosure, the cylindrical cap which also serves as a measuring cup is set to the dispensing adapter by screw threads, and devised to seal the dispensing spout. Thus, the residual adherent to the inside of the cap is returned to the container through the return hole.

However, the inner circumference of the dispensing adapter and the outer circumference of the cap are connected by the screwing threads. Thus, the residual liquid remaining among the threads sometimes drips out when screwing.

In order to overcome the above inconvenience, Japanese Patent Publication No. 61-180961 also discloses a mechanism which provides a threaded engagement between the inner circumference of the cap and the outer circumference of the basic part of the dispensing cylinder. Residual liquid remaining among the threads is thus prevented from dripping out. The device described by Japanese Patent Publication No. 61-180961 can return residual liquid into the container body, but the return is effected only along a very narrow part to be screwed.

Especially by this device, when the container body is inverted, a considerable quantity of liquid will come into the cap through the cylinder. Accordingly, a further and unexpected long time is needed to restore the liquid into the correct place when the container body is returned to a standing position.

SUMMARY OF THE INVENTION

An object of the present invention is to resolve the aforementioned problems, and to supply a dispensing and closing package for liquid products, whereon the basic part of the dispensing cylinder circumscribes the inside of the cap by screw threads. When the cap is placed on the container, the residual liquid adherent in the cap will return into the container body rapidly and surely.

Another object of the invention is to provide a path adjacent to the meeting point of the cap and the dispensing cylinder, through which residual liquid immediately returns to the container body in smooth flow.

A further object of the invention is to provide a dispensing cylinder of long durability made by a plastic injection method, and having strong clamping power without any transformation when it threadedly engages the cap.

The invention includes a dispensing adapter, having the setting cylinder in the outside and the dispensing cylinder in the inside, both connected across over a "U" valley wall, which is mounted on the mouth of the container body in a completely sealed condition. The basic part of the dispensing cylinder circumscribes the inside of the cap which is automatically fit on or off. Adjacent to the meeting point of the cap and the dispensing cylinder, a path is formed, through which residual liquid immediately returns to the container body. On the bottom of the "U" valley wall, a return hole is established, whereto residual liquids conform to run via a sloped drain formed also on the bottom of the "U" valley wall.

DETAILED DESCRIPTION OF THE PREFERRED EMBODIMENTS

Figure 1:
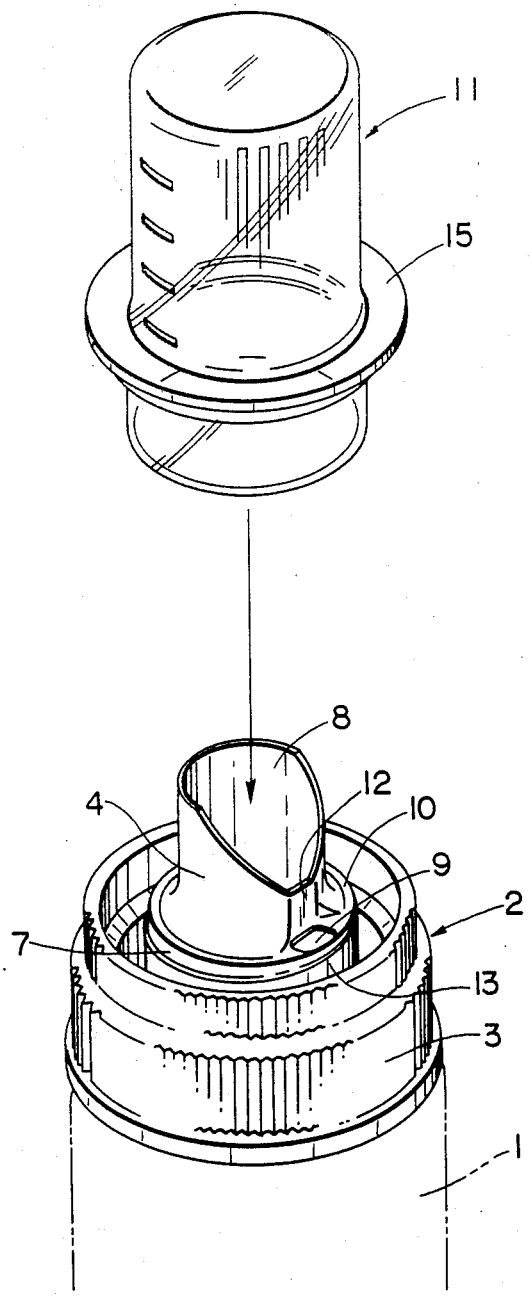
FIG. 1 is a perspective view of a dispensing and closing package according to a preferred embodiment of the present invention.
Figure 2:
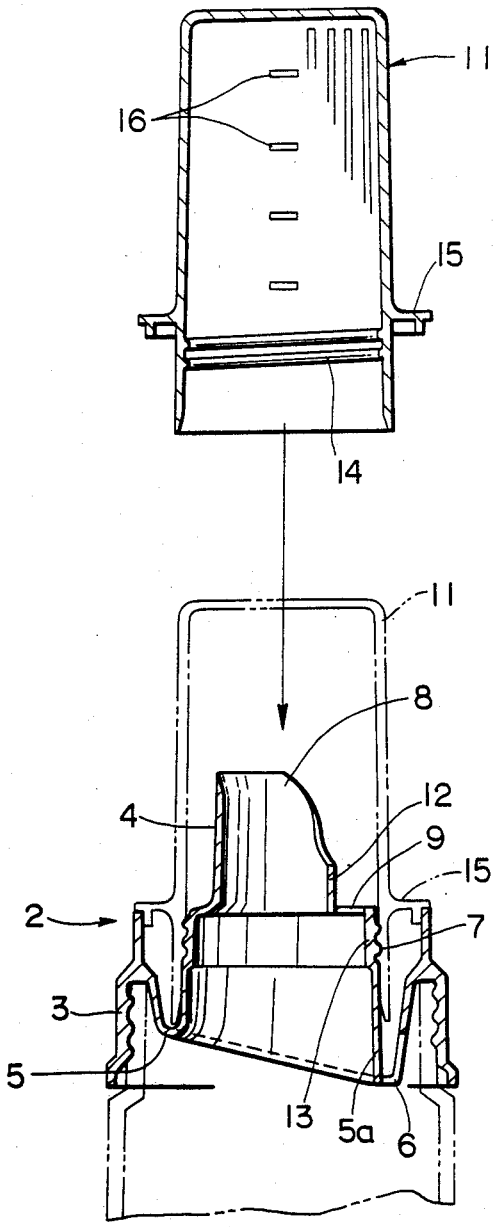
FIG. 2 is a vertical sectional view of the FIG. 1 embodiment.
Figure 3:
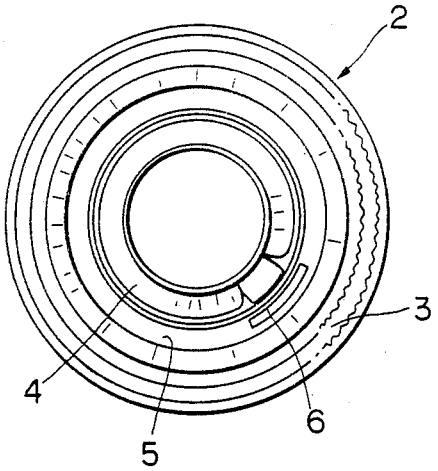
FIG. 3 is a plan view of a dispensing adapter of the present invention.
Figure 4:
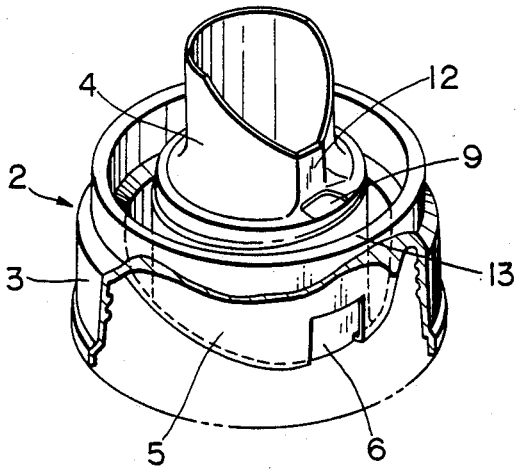
FIG. 4 is a partially cutaway perspective view of the dispensing adapter of FIG. 3.

The preferred embodiments of this invention shall be now explained as follows, with reference to the attached drawings:

Numeral 1 refers to a container body which contains a liquid product, such as detergent or edible oil. An adapter 2 is mounted on a mouth of the container body. The adapter 2 includes an outer setting cylinder 3 and an inner dispensing cylinder 4. The setting cylinder 3 is mounted perfectly on the mouth of the container body in a sealed condition. The dispensing cylinder 4 protrudes upward from the setting cylinder 3. Both cylinders are interconnected through an annular wall 5 having a U-shape in cross-section.

The U-shaped wall 5 has one end which begins approximately at the middle part of the inside of the setting cylinder 3. The other end extends to the lower part of the dispensing cylinder 4. The inner circumference of the setting cylinder threadedly engages the mouth of the container body 1 by means of threads provided on a lower part thereof. The threads extend lower than the U-shaped "valley" wall 5. The upper part of the wall 5 is threaded for engaging a cap 11 (which will be described in greater detail below) in a sealed condition. At the bottom of the valley wall 5, a sloped drain is formed into a collecting point, at which a return hole 6 is formed. Liquid products initially adhering to and collecting in the valley wall 5 pass to the return hole 6 along the sloped drain, whereupon they are returned to the container body 1.

The dispensing cylinder 4 is a cylindrical pipe having open upper and lower ends, and dispenses the liquid product. Screw threads 7 are provided on its lower part so as to threadedly engage the cap 11. A dispensing spout 8 is formed at its top and is cut at a slant so that air ventilation is provided when dispensing. The spout 8 also directs flow in a desired dispensing direction. Adjacent to the screw threads 7 is a passageway 9 which is provided just below the above-mentioned slant-cut part of the spout. The passageway 9 goes through in and out the dispensing cylinder 4.

Figure 11:
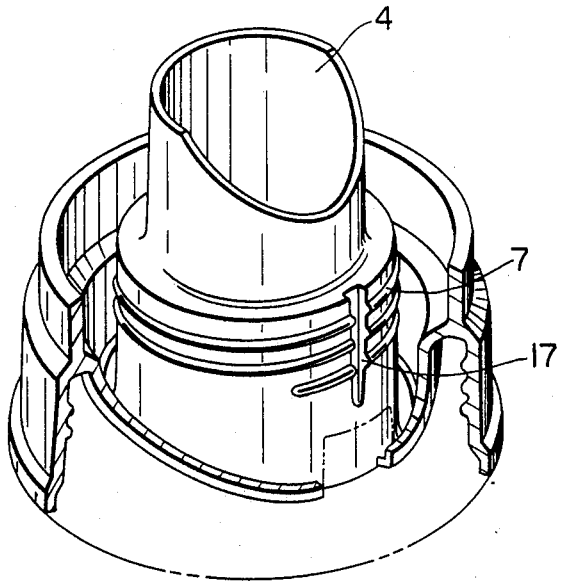
FIG. 11 is a partially cutaway perspective view of a dispensing adapter of another embodiment of the present invention.
Figure 12:
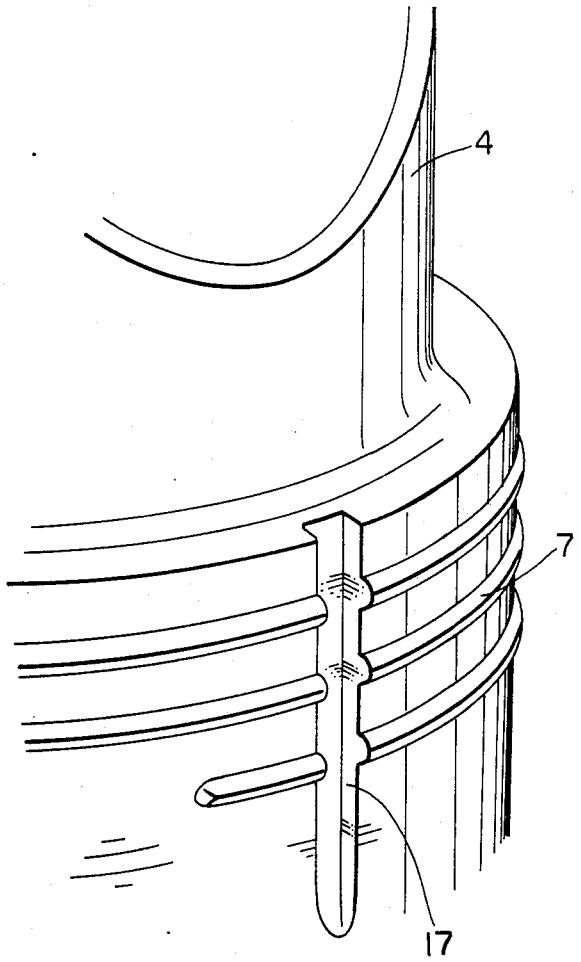
FIG. 12 is an enlarged and detailed perspective view of the adapter of FIG. 11.
Figure 13:
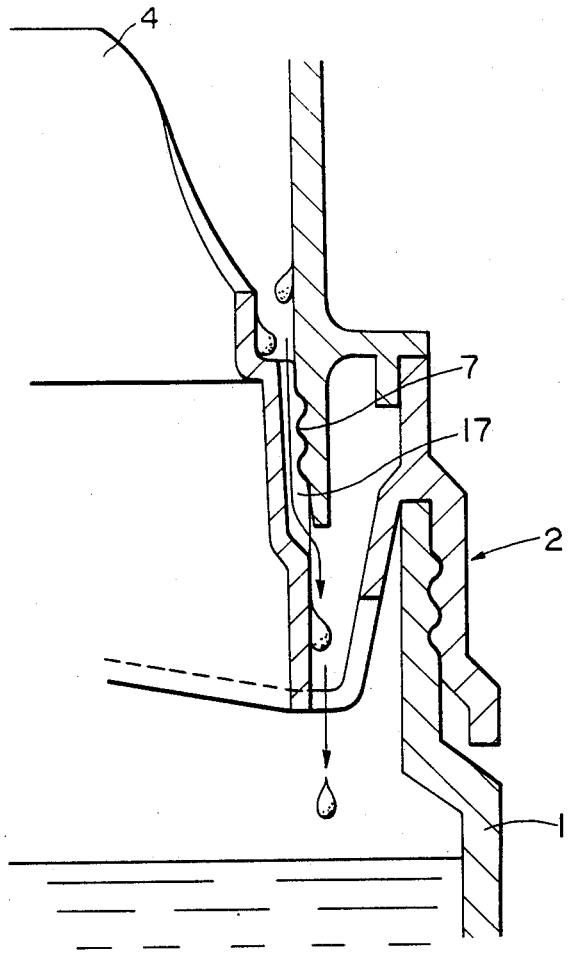
FIG. 13 is an enlarged and detailed sectional view of the adapter of FIG. 11.
Figure 14:
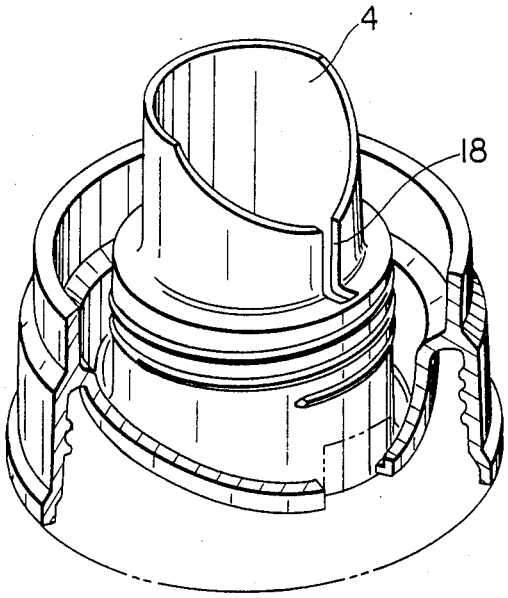
FIG. 14 is a partially cutaway perspective view of a dispensing adapter according to another embodiment of the present invention.
Figure 15:
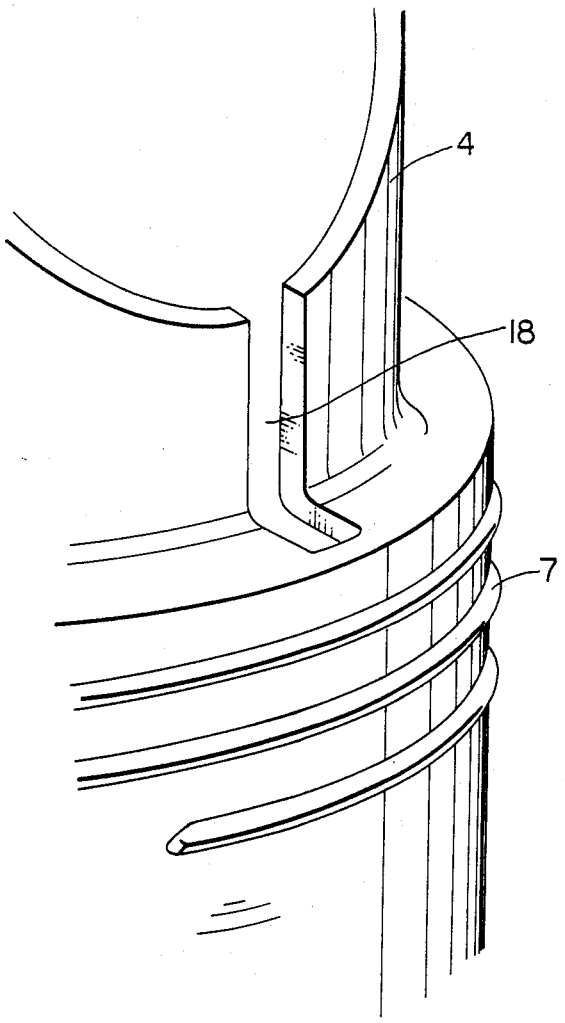
FIG. 15 is an enlarged and detailed perspective view of the adapter of FIG. 14.
Figure 16:
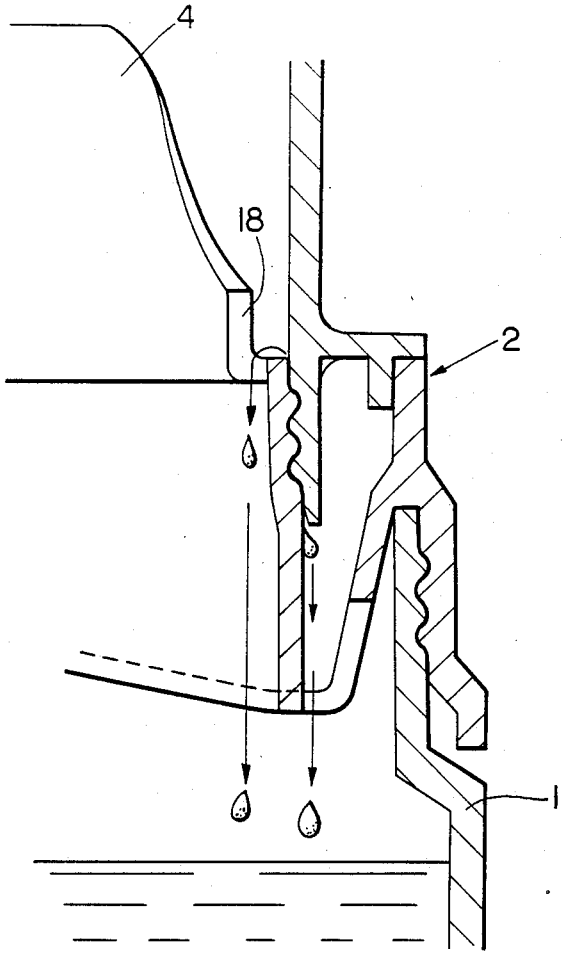
FIG. 16 is an enlarged and detailed sectional view of the adapter of FIG. 14.

In accordance with the preferred embodiment as shown, the passageway 9 is a connecting hole drilled on an annular platform 10 adjacent to the top part of the screw threads 7. However, other modifications are also available within the true spirit and scope of this invention. As shown in FIG. 11, an axial groove 17 may be used which extends vertically through the screw threads. The groove may be provided in the screw threads of the cap 11 as well. A passageway shall also be available by the slot 18 which is cut downwardly from the dispensing spout 8 to the screw threads 7, as shown in FIG. 14. In effect, the passageway is available in various forms so long as it seats adjacent the meeting point of the dispensing cylinder 4 and the cap 11 and so long as it communicates between the container body 1 and the cap 11 when divisioned by the dispensing cylinder 4.

As shown in FIG. 1 to FIG. 10, the passageway 9 is a connecting hole. Walls 12 and 13 circulate around the passageway. The dispensing cylinder 4 is produced by the so-called injection molding process. Also when the cap 11 is equipped with the cylinder, deterioration of the screw is not incurred by transformation, hystereris and so on.

The cap is made in the form of a cylinder with a bottom. In the inner circumference of its mount are formed the complementary screw threads 14 which engage screw threads 7 of the dispensing cylinder 4. The threaded engagement provides a complete sealed condition.

A sealing flange 15 is provided on the outer circumference of the cap 11 in the form of a transition collar, which provides complete sealing when combined together. It is preferable to use this cap 11 as a measuring cup, with a scale 16 imprinted in the transparent or translucent material of the cap.

Figure 5:
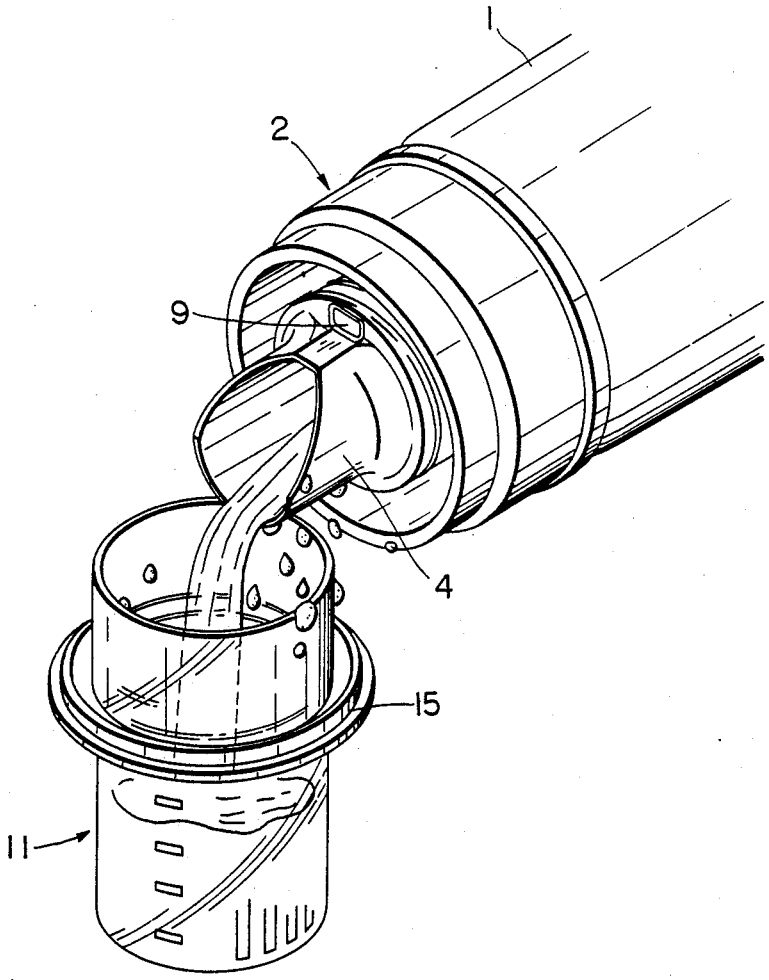
FIG. 5 is a perspective view of the invention in use for dispensing and measuring.
Figure 6:
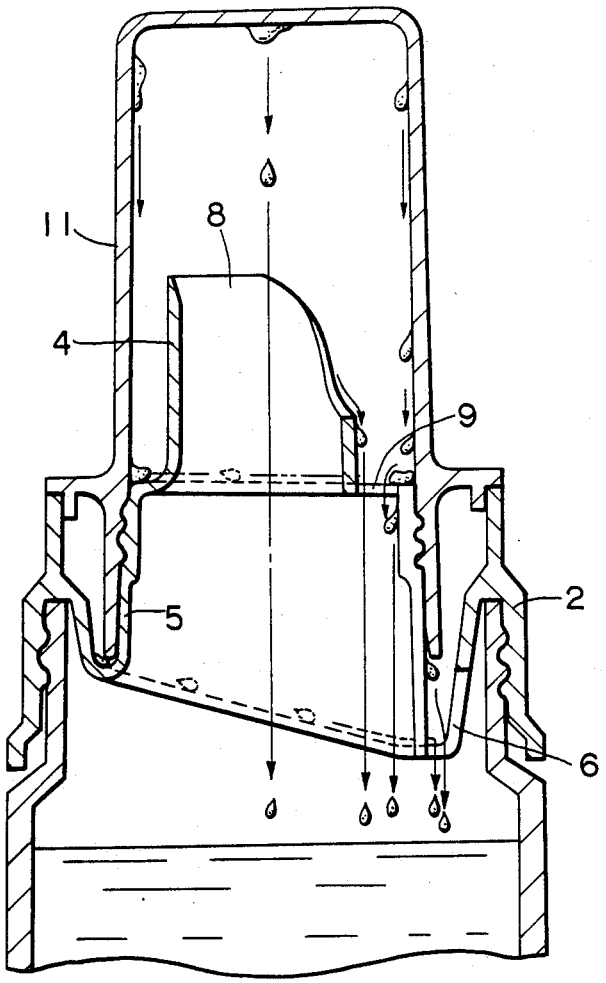
FIG. 6 is a longitudinal sectional view of the invention returning residual liquid after dispensing.

For dispensing, as shown in FIG. 5, the cap 11 is removed and liquid products are poured from the body container 1. The cap 11 may be used for measuring the dispensed quantity. After dispensing, the cap is reattached to the container body 1. Then, liquid products spilled out of the dispensing spout 8 onto the outside of the dispensing cylinder 4 come to the bottom of the wall 5 and return to the container body 1 through the return hole 6 along the sloped drain, as shown in FIG. 6.

Liquid products which remain or clog in the inside of the cap 11 disperse along on the annular platform and pass through passageway 9 to come back into the container body. At that stage, the liquid products which even disperse into the opposite direction shall be also drawn to the passageway 9 influenced by other running flow power of liquid products.

Figure 7:
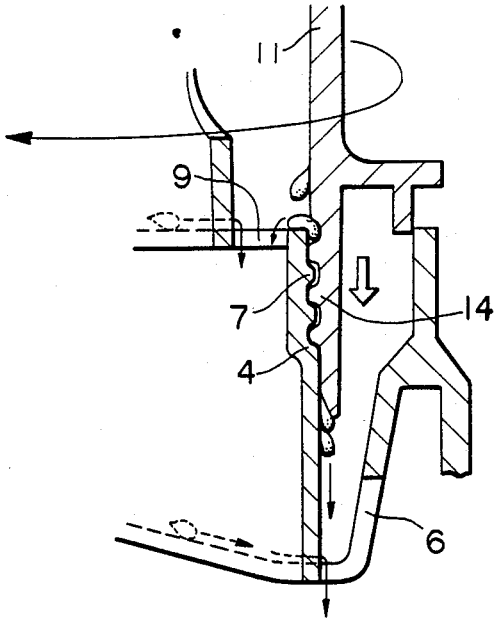
FIG. 7 and FIG. 8 are enlarged sectional views showing spilled and returned liquid.
Figure 8:
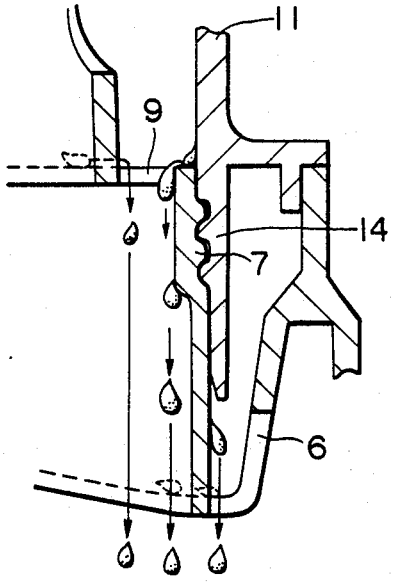

As shown in FIG. 7 and FIG. 8, the liquid products which ooze out amount the screw threads 7 and 14 come finally into the container body 1 through the return hole 6 or passageway 9.

Figure 9:
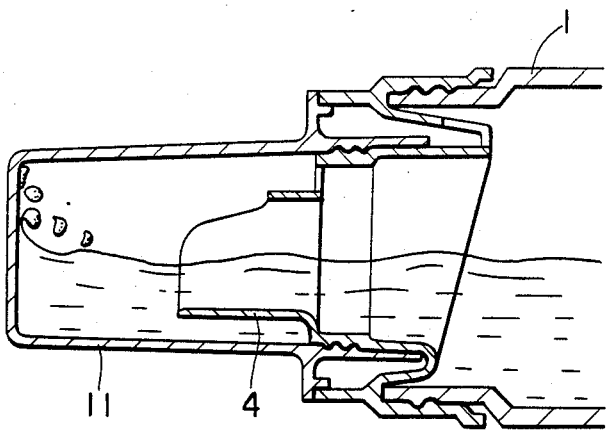
FIG. 9 is a cross-sectional view showing flow of liquid when the container body is inverted.
Figure 10:
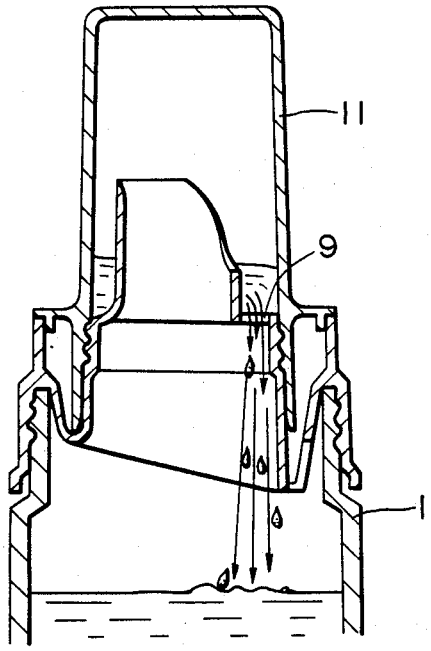
FIG. 10 is a cross-sectional view showing back flow of liquid when the container body is returned to a standing position.

As shown in FIG. 9, when the container body 1 is thrown down or inverted, liquid products run into the cap 11 via the dispensing cylinder 4, but when the container body 1 is restored to a previous position, as shown in FIG. 10, the liquid products come back into the container body 1 naturally through the passageway. Thus, no residual adherent liquid products exist.

What is claimed is:

1. A dispensing and closing package for liquid products comprising:
   - a container body having a mouth;
   - a dispensing adapter mounted on the mouth of the container body and including a setting cylinder and a dispensing cylinder interconnected to the setting cylinder by a valley wall having a bottom;
   - a sloped drain provided on the bottom of the valley wall, and including a return hole provided on a lowest point of the drain;
   - a cap having an open bottom fitting over an outer circumference of the dispensing cylinder; and
   - a passageway formed adjacent to a common point between the dispensing cylinder and the cap, for communicating an inside of the container body with an inside of the cap, and being operative to return dripped liquid products over an outer face of the dispensing cylinder into the container body through the return hole along the sloped drain and also adapted to return liquid products remaining in the inside of the cap into the container body through the passageway.

2. A package according to claim 1, further comprising a platform formed on the dispensing cylinder adjacent to the common point of the dispensing cylinder and the cap, whereon the passageway is located.

3. A package according to claim 1, wherein the passageway is formed by a groove penetrating vertically on the common point of the dispensing cylinder and the cap.

4. A package according to claim 1, wherein the passageway is formed by a slot cut down axially from a dispensing spout provided in the dispensing cylinder and extending to the common point with the cap.

5. A package according to claim 1, wherein the cap provides a measuring cup.

6. A dispensing and closing package for liquid products comprising:
   - a container body having a mouth;
   - a dispensing adapter mounted on the mouth of the container body and including a setting cylinder and a dispensing cylinder interconnected to the setting cylinder by a valley wall having a bottom;

a sloped drain provided on the bottom of the valley wall, and including a return hole provided on a lowest point of the drain;

a cap having an open bottom fitting over an outer circumference of the dispensing cylinder; and an annular platform provided on the dispensing cylinder adjacent a common point of the dispensing cylinder and the cap, a connecting hole being formed through the platform, and being operable to return dripped liquid products from an outer face of the dispensing cylinder into the container body through the return hole and to return liquid products remaining on an inside of the cap to the container body through the connecting hole.

7. An apparatus according to claim 3, wherein the cap provides a measuring cup.

* * * * *

UNITED STATES PATENT AND TRADEMARK OFFICE

CERTIFICATE OF CORRECTION

PATENT NO. : 4,890,770

DATED : January 2, 1990

INVENTOR(S) : Haga, et al

It is certified that error appears in the above-identified patent and that said Letters Patent is hereby corrected as shown below:

Col. 6, claim 7, line 1, change "7" to --6--.

Signed and Sealed this

Fifteenth Day of January, 1991

*Attest:*

HARRY F. MANBECK, JR.

*Attesting Officer*

*Commissioner of Patents and Trademarks*